United States Patent [19]

Gordon

[11] 4,036,423

[45] July 19, 1977

[54] EXPANDABLE PACKAGE

[75] Inventor: Robert L. Gordon, Monroe, N.Y.

[73] Assignee: International Paper Company, New York, N.Y.

[21] Appl. No.: 689,494

[22] Filed: May 24, 1976

Related U.S. Application Data

[63] Continuation of Ser. No. 517,145, Oct. 23, 1974, abandoned.

[51] Int. Cl.[2] ..... B65B 43/02; B65B 85/70

[52] U.S. Cl. ..... 229/43; 229/31 R; 229/DIG. 3; 426/111

[58] Field of Search ..... 426/111, 113, 234; 126/390; 229/3.5 MF, 31 R, DIG. 3, 43, 41 D

[56] References Cited

U.S. PATENT DOCUMENTS

| | | | |
|---|---|---|---|
| 2,407,118 | 9/1946 | Waters | 93/49 |
| 2,844,475 | 7/1958 | Barnes et al. | 426/113 |
| 2,858,970 | 11/1958 | Barnes et al. | 426/111 |
| 3,112,855 | 12/1963 | Hennessey et al. | 229/43 |
| 3,114,300 | 12/1963 | Bianchi | 229/14 BL |
| 3,316,102 | 4/1967 | Doll | 99/171 |
| 3,346,399 | 10/1967 | Watson et al. | 426/111 |
| 3,507,668 | 4/1970 | Bridgford | 426/113 |
| 3,531,298 | 9/1970 | Donahue | 426/111 |
| 3,550,835 | 12/1970 | Persson | 229/31 R |
| 3,734,749 | 5/1973 | Bridgford | 426/111 |
| 3,883,068 | 5/1975 | Silver | 229/14 BL |
| 3,969,535 | 7/1976 | Bourns | 426/111 |
| 3,973,045 | 8/1976 | Brandberg et al. | 426/113 |

*Primary Examiner*—Stephen P. Garbe
*Assistant Examiner*—Bruce H. Bernstein
*Attorney, Agent, or Firm*—John A. Caruso

[57] ABSTRACT

A non-metallic, expandable food package for use in a microwave oven is disclosed. The package comprises a leak-proof box-like base portion having an integral flange to which a cover is securely attached. The flange portion is then foldably closed to provide a package having a small storage volume.

9 Claims, 9 Drawing Figures

FIG. 2
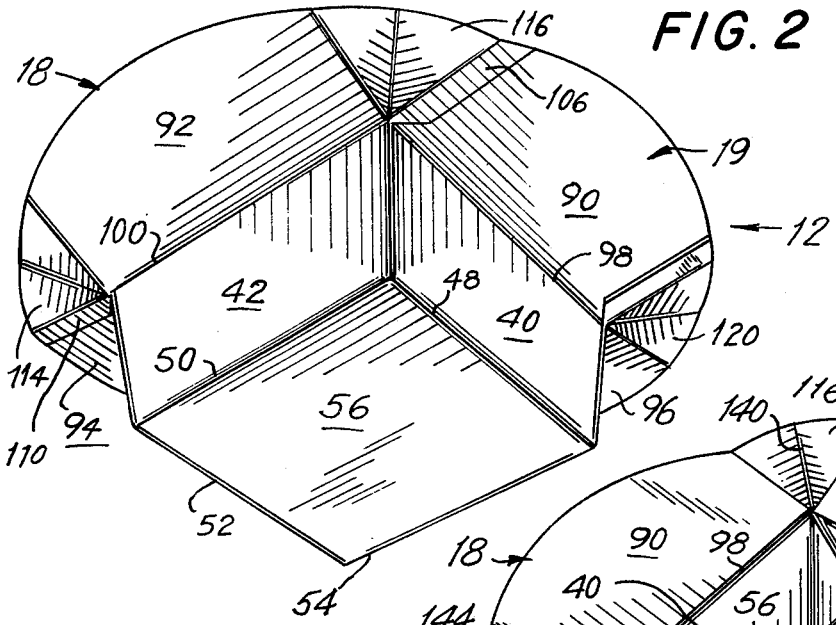
FIG. 3
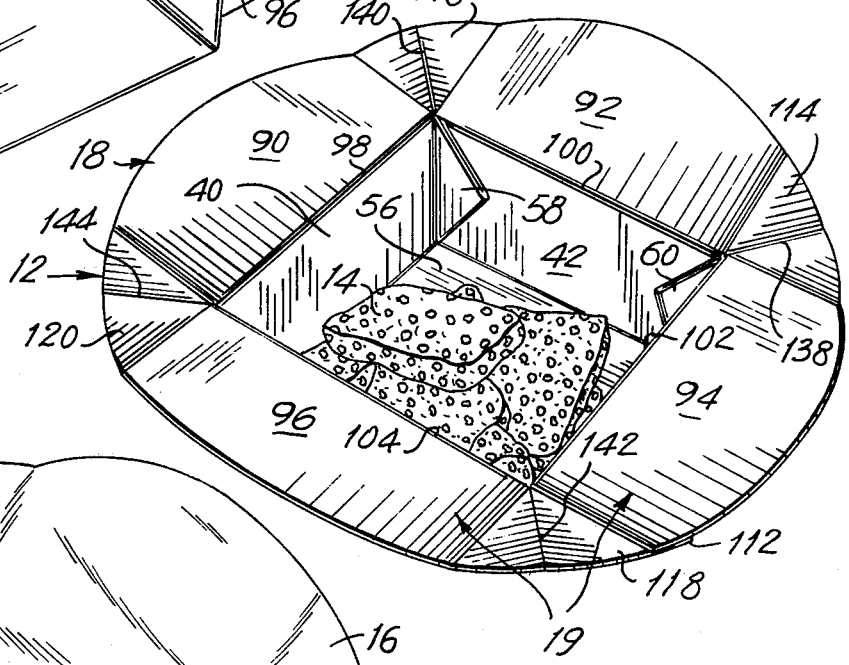
FIG. 4
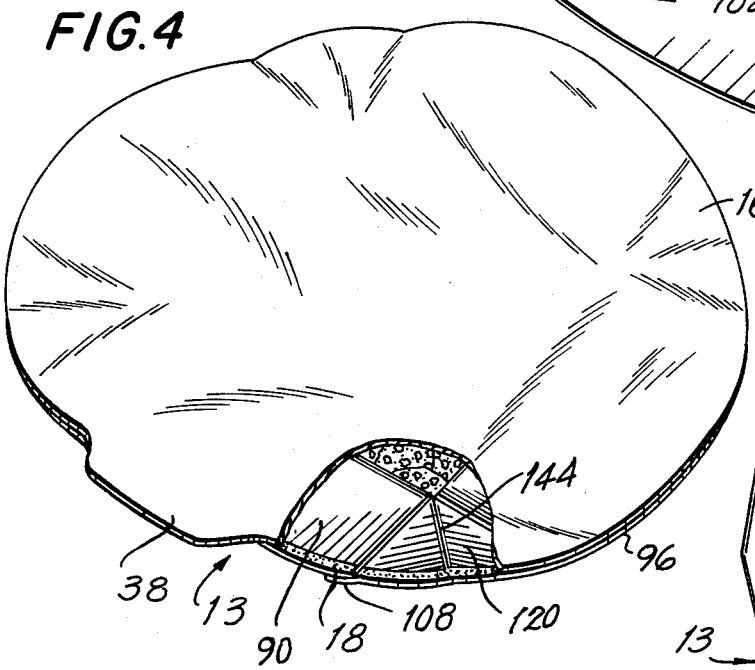
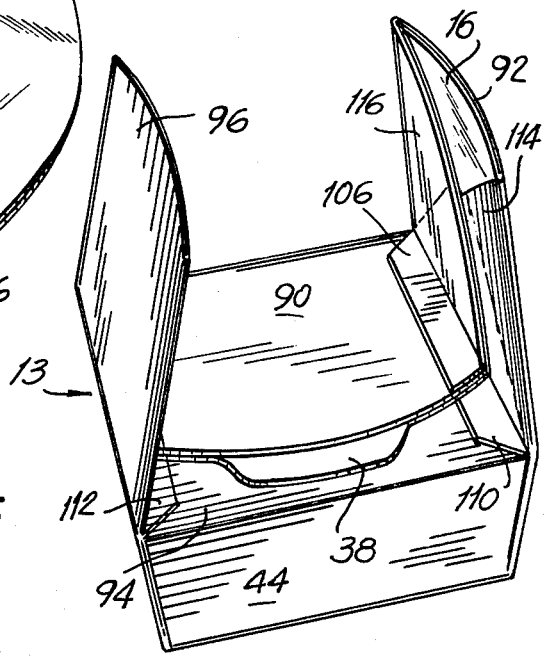
FIG. 5

EXPANDABLE PACKAGE

This is a continuation of application Ser. No. 517,145, filed Oct. 23, 1974, now abandoned.

BACKGROUND OF THE INVENTION

This invention relates generally to food packages and more particularly to expandable food packages constructed of non-metallic mterials for use in a microwave oven.

Many expandable food packages have been contructed for use, for example, in packaging and cooking corn kernels for popcorn. Generally, the package is placed over a heat source under the influence of which cooking fats or oils, placed in the package, melt and form a gas while simultaneously the corn kernels are cooked to form popcorn, the combination causing the package to expand. Prior packages generally utilize a shallow metallic container for holding the food to be cooked covered by a thin foil cover. The cover expands under the influence of internal pressure from the cooked food to provide an internal volume greater than three times the original size.

A principle advantage of using an expandable package in which cooking can be preformed is the resulting economy of space in the storing and stacking of the packages. Another advantage is the convenience for the user of not having to transfer or handle the cooking ingredients stored in the package.

Unfortunately, packages incorporating metals cannot be used in a microwave oven because the metal acts as a shield thereby preventing the energy from reaching the food. Thus the food cannot be heated and cooked. As a result, it is necessary to design an expandable food package which is entirely non-metallic.

It is therefore an object of the invention to provide a non-metallic expandable food package for use in a microwave oven which is capable of expanding to at least three times its storage or unexpanded volume. Further objects of the invention are to provide a non-metallic, expandable food package which is inexpensive, simple to construct, easy to stack, will contain hot oils and cooking fats without leaking, is resistant to grease, is sanitary, and which, when expanded, will be selfsupporting. It is a still further object of the invention to provide a non-metallic, expandable food package which can be dispensed from a vending machine, which is easy to open, and which can be used as a bowl after cooking.

SUMMARY OF THE INVENTION

The invention features an expandable non-metallic food package having a base portion and a cover. The base portion includes an open container section having a bottom polygonal panel which, with side and connecting panels, forms a leak proof structure. Foldably attached to the opening of the container section is an integral flange portion having a continuous outer periphery. A cover is secured to the flange portion along its entire outer periphery thereby completely enclosing the base portion.

In a preferred embodiment, the invention features a truncated pyramidal base portion having side panels which are tapered outwardly. The entire base portion is formed from a single blank of non-metallic sheet material. In one particular embodiment, outer periphery of the flange portion is circular.

BRIEF DESCRIPTION OF THE DRAWINGS

Other objects, features and advantages of the invention will appear from the following description of a preferred embodiment of the invention taken together with the attached drawings thereof in which:

FIG. 2 shows the preferred embodiment of the base portion of the package looking from the bottom panel of the base portion;

FIG. 3 shows in top perspective view the preferred embodiment of the base portion containing pieces of corn kernels with cooking fats;

FIG. 4 shows the referred embodiment of the package with its top cover partially broken away;

FIG. 5 shows the preferred embodiment of the package with its panels partially closed;

DESCRIPTION OF A PREFERRED EMBODIMENT

Figure 1:
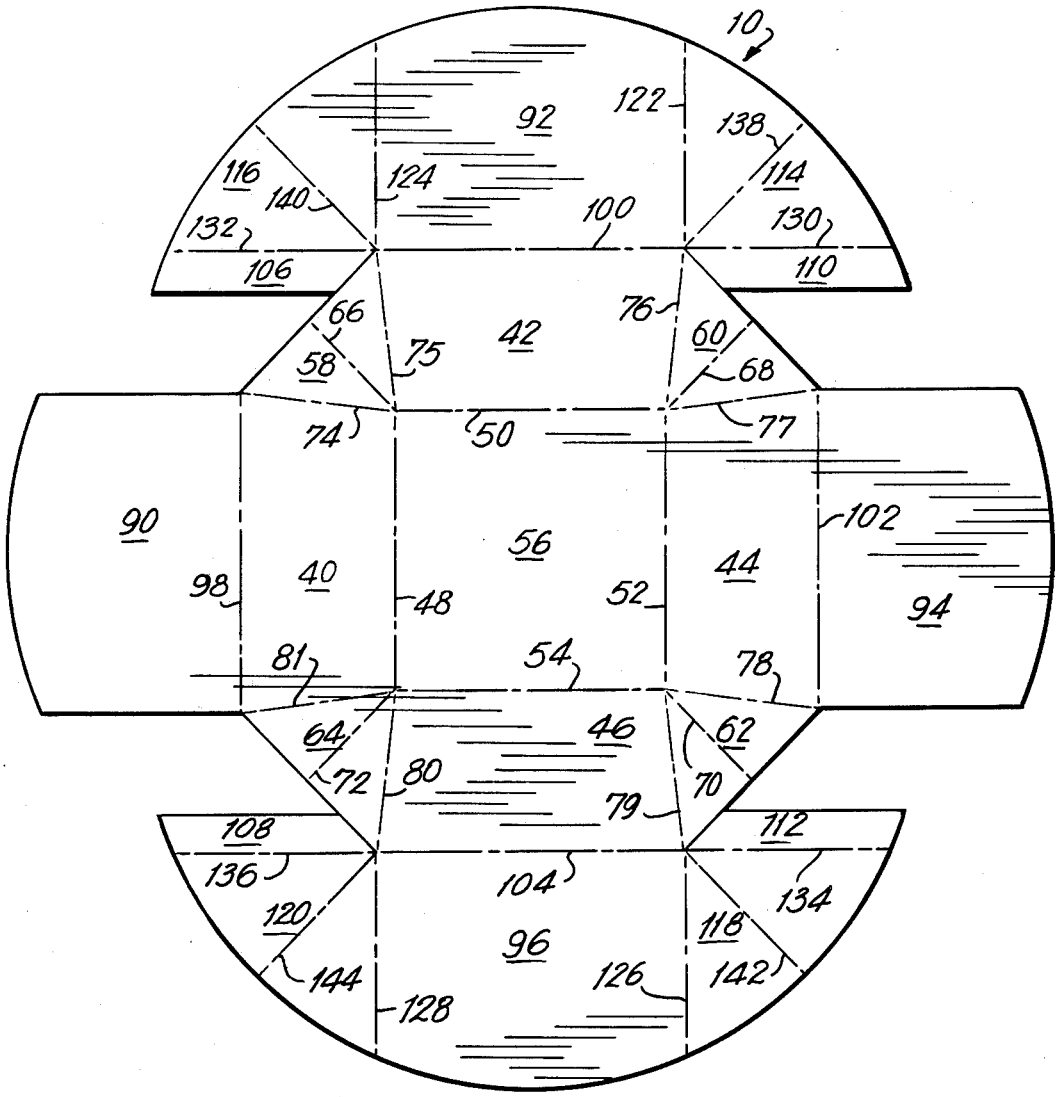
FIG. 1 shows a cut and scored blank of sheet material which is used in the preferred embodiment to form the base portion of the package.
Figure 6:
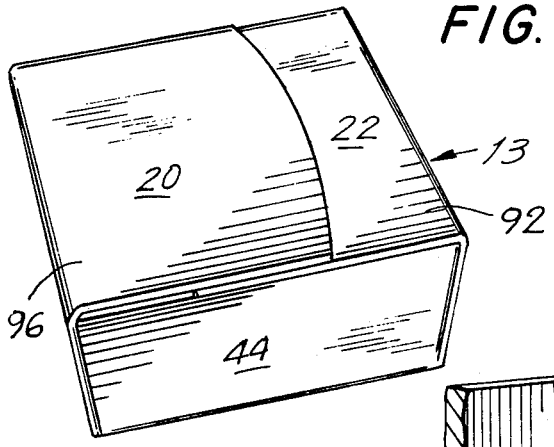
FIG. 6 shows the preferred embodiment of the package closed and ready for stacking and storage.
Figure 7:
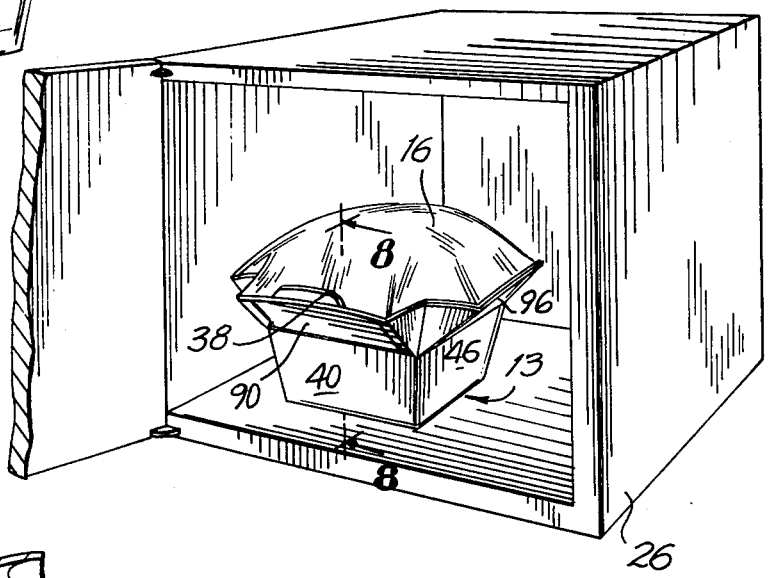
FIG. 7 shows the preferred embodiment of the package in a microwave oven after cooking.

FIG. 1 shows a blank 10, scored along the dotted lines and cut along the solid lines. When folded, blank 10 forms a base portion 12 (see FIG. 2) of an expandable package 13. Base portion 12 receives food, such as uncooked kernels of corn with congealed cooking oil 14 (FIG. 3), and a cover 16 (FIG. 4) is secured around the continuous peripery 18 of a flange portion 19 of base portion 12. The package is then closed by folding panels of the flange portion (FIGS. 5 and 6). Panels 20 and 22 (FIG. 6) of the flange portion are secured to one another, preferably by spot gluing for easy opening at a later time, to provide a closed, sealed expandable package 13 ready for both storage and cooking. At a later time, package 13 is reopened to the position shown in FIG. 4 and is placed in a microwave oven 26 for cooking. The gases and popped corn generated within the expandable package cause the flange portion to assume a bowl-like structure and the cover to assume a dome-like configuration (FIG. 7). The partially vertical flange portion supports the popcorn, while the cover 16 prevents the popcorn from escaping from the interior of the package. The cover 16 is then removed preferably using a pull tab 38 thereby exposing the cooked product, while the flange portion 19 of the base portion 12 supports the cooked product in a bowl shape (see FIG. 9).

The base portion 12 is constructed from the blank 10 shown in FIG. 1 as follows. A plurality of side panels 40, 42, 44, and 46 are folded respectively along score lines 48, 50, 52, and 54 to form a container section with central polygonal panel 56, here shown as a square to which the side panels are foldably connected. Central panel 56 serves as the bottom of the container section. As side panels 40, 42, 44, 46 are folded along their respective common boundaries with central panel 56, connecting panels 58, 60, 62, 64 are folded inwardly along internal dividing score lines 66, 68, 70, 72 and along score lines 74, 75, 76, 77, 78, 79, 80, 81 between the connecting panels and the side panels. Now folded connecting panels 58, 60, 62, 64 (see also FIG. 3) are folded against and adhesively secured to the side panels, preferably panels 42, 46. The resulting container section is a box-like structure having a continuous leak-proof interior section without seams. This results from the central panel, side walls, and connecting panels forming a continuous surface, that is, a surface having no interior openings or cuts. In the preferred embodiment, the resulting container section has trapezoidal side panels which cause the sides of the container section to be slightly tapered outward to form an inverted truncated pyramidal base structure. The trapezoidal side panels enable unpopped kernels of corn to return to the bottom of the container during cooking.

Vertical support panels 90, 92, 94, 96 are then folded outward along score lines 98, 100, 102, 104 respectively. Connecting flap portions 106, 108 of panels 92, 96 respectively are then adhesively bound to panel 90 and connecting flap portions 110, 112 of panels 92, 96 are adhesively bound to panel 94. In the preferred embodiment flaps 106, 108, 110, 112 are bound to the underside (looking at FIG. 1) of panels 90 and 94 respectively. The resulting flange portion 19 is comprised of adhesively bound panels 90, 92, 94, 96 which are foldably connected to the side panels of the container section, which have an inner opening of the same shape as the central panel 56, and which, in this particular embodiment, have an outer periphery which is substantially circular. In other embodiments, the outer periphery may have other shapes so long as a cover may be attached along a continuous seam as described in detail below. The resulting structure is shown as base portion 12 in FIGS. 2 and 3.

In the preferred embodiment, for use as a popcorn package, the sheet material from which blank 10 is formed, is either a chemically treated, grease resistant board or a paperboard, polyethylene, paperboard lamination. Other nonmetallic materials or combinations of materials could also be used provided they sufficiently resist leakage of cooking oils and fats which are to be contained by the base portion.

Figure 8:
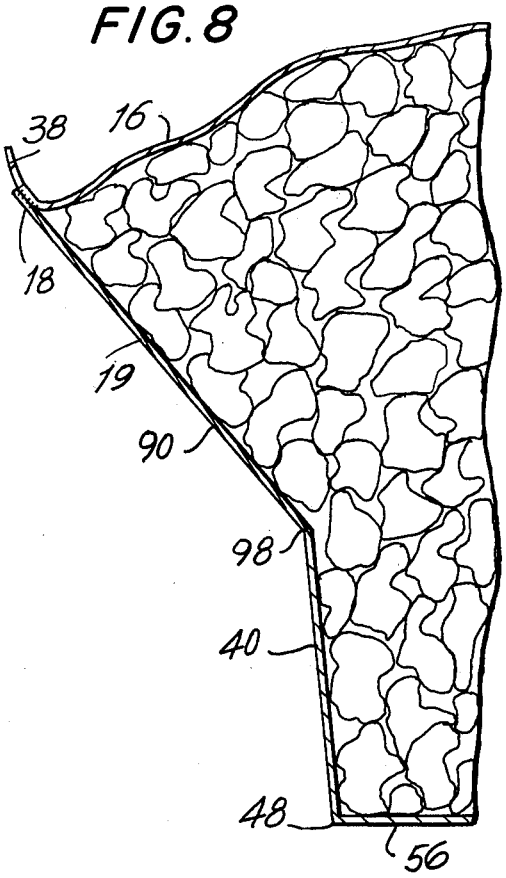
FIG. 8 shows a section of the referred embodiment of the package taken along lines 8—8 of FIG. 7.

After the food to be cooked is placed in the container, cover 16 is adhesively or heat sealed bonded along a one-quarter inch strip around the periphery 18 of flange 19 to form a closed container (FIGS. 4 and 8). Preferably a heat sealing process is used in which case the cover may be a paper/polyethylene lamination in which the paper is on the outside of the package. Vertical support panels 90 and 94 and connecting panel portions 114, 116, 118, 120 of vertical support panels 92, 96 are then folded inwardly along with score lines 98, 102, 122, 124, 126, 128 respectively. Panels 92 and 96 are then folded inwardly as shown in FIGS. 5 and 6 along score lines 100 and 104 to form a closed expandable package. As panels 92 and 94 are folded, connecting panels 114, 116 of panel 96 and 118, 120 of panel 96 are folded along score lines 130, 132, 134, and 136 respectively.

Figure 9:
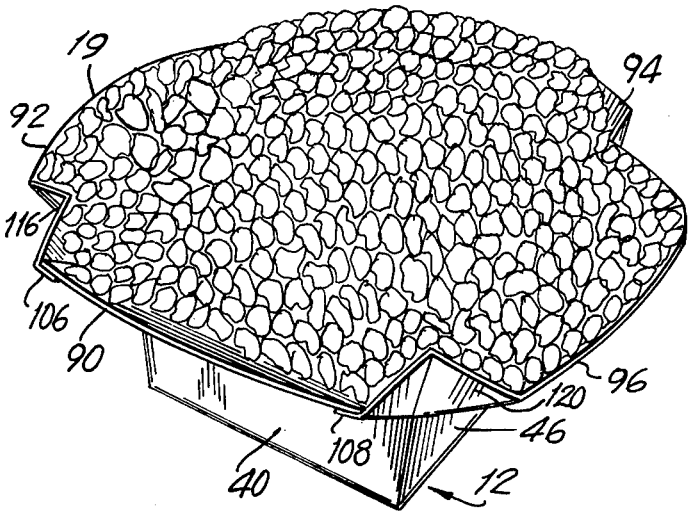
FIG. 9 shows the preferred embodiment of the packge having the cover removed thereby exposing the cooked popcorn.

As noted above, the panels which are closed last are spot glued and the package is then ready to be stored. Before the package is placed in a microwave oven for heating, the flange panels are opened, preferably using pull tab 38, to the position shown in FIG. 4. Then, the kernels of corn and the cooking fats or oils, as they heat, provide the pressure within the closed package to bring panels 90, 92, 94, 96 closer to a vertical position with connecting panels 114, 116, 118, 120 folded inwardly along internal score lines 138, 140, 142, 144 as shown in FIGS. 7 and 9.

As noted above, the cover 16 can then be removed using pull tab 38 and the base portion of the package can be used as a container or bowl from which the popcorn can be served.

Other embodiments will occur to those skilled in the art and are within the following claims.

What is claimed is:

1. A non-metallic food package comprising a base portion and a flexible cover and capable of providing in an expanded condition a volume substantially greater than the volume of the package in a storage condition, said base portion comprising a bottom panel of polygonal shape, side panels foldably connected to said bottom panel to form an open container section, and a flange portion foldably connected to said side panels, said flange portion comprising a plurality of vertical support panels and connecting panels therebetween, each connecting panel being foldably connected to one adjacent vertical support panel and being adhesively bound to another adjacent vertical support panel, so that said flange portion has a continuous outer periphery, said flexible cover being secured to said flange portion along said outer periphery, said flange portion being folded inwardly of the side panels into said open container section, and said connecting panels being outwardly expandable, whereby said flange portion and said flexible cover provide said package in the expanded condition with a volume substantially greater than the volume of the package in the storage condition.

2. The food package of claim 1 wherein each vertical support panel, in said stored condition, at least partially overlies each of the other vertical support panels.

3. The food package of claim 1 in which said bottom panel has the shape of a regular polygon and said side panels are tapered outward.

4. The food package of claim 1 wherein said bottom panel is square and said side panels are trapezoidal.

5. The food package of claim 1 in which said base portion is formed from a single blank of sheet material and said flange portion comprises a plurality of adhesively bound panels.

6. The food package of claim 1 in which the base portion is a polyethylene, paperboard laminate.

7. The food package of claim 1 in which said flexible cover is a paper/polyethylene lamination.

8. The food package of claim 1 in which at least two of said vertical support panels, in said stored condition, overlap to completely enclose the open container section formed by said bottom panel and said side panels.

9. A non-metallic food package comprising a base portion formed from a single blank of sheet material and having a bottom panel of polygonal shape, side panels foldably connected to said bottom panel to form an open container section, and an outwardly directed flange portion foldably connected to said side panels, said flange portion comprising a plurality of vertical support panels and connecting panels therebetween, each connecting panel being foldably connected to one adjacent vertical support panel and being adhesively bound to another adjacent vertical support panel, so that said flange portion has a substantially circular, continuous, outer periphery spaced away from said side panels, said bottom panel and said side panels having a substantially inverted truncated pyramidal shape, a flexible, non-metallic cover secured to the flange portion on its outer periphery, said flange portion being folded inwardly of the side panels into said open container section, and said connecting panels being outwardly expandable, whereby said flange portion and said flexible cover provide said package in the expanded condition with a volume substantially greater than the volume of the package in the storage condition.

* * * * *